United States Patent [19]

Wagner et al.

[11] 4,162,050

[45] Jul. 24, 1979

[54] OUTSIDE PAYOFF

[75] Inventors: William A. Wagner, Somers; Frank W. Kotzur, Mahopac, both of N.Y.

[73] Assignee: Windings, Inc., Goldens Bridge, N.Y.

[21] Appl. No.: 831,085

[22] Filed: Sep. 6, 1977

[51] Int. Cl.[2] ..... B65H 55/00

[52] U.S. Cl. ..... 242/163

[58] Field of Search ..... 242/96, 129.8, 134, 242/136, 139, 141, 146, 163-166

[56] References Cited

U.S. PATENT DOCUMENTS

| | | | |
|---|---|---|---|
| 963,114 | 7/1910 | Berry | 242/163 |
| 1,328,777 | 1/1920 | Zeryudachi | 242/139 |
| 2,634,922 | 4/1953 | Taylor, Jr. | 242/163 |
| 3,764,086 | 10/1973 | Garzonio | 242/141 |

*Primary Examiner*—Leonard D. Christian

*Attorney, Agent, or Firm*—Watson, Cole, Grindle & Watson

[57] ABSTRACT

Method and apparatus for providing outside payoff from a wound package of flexible strip-like material wherein the package is mounted on a swivable support member through a radial hole in the wound material. The support member is mounted to enable oscillation about its longitudinal axis and the wound material is paid-off the package from its outer end by pulling it in a direction transverse to the longitudinal axis of the wound material and the support member. Tension forces may be provided to the support tube to prevent premature throw-off of the wind by controlling the oscillation of the package. Such tension forces may be provided by springs attached to the support tube or by mounting the support tube on a torque motor.

17 Claims, 8 Drawing Figures

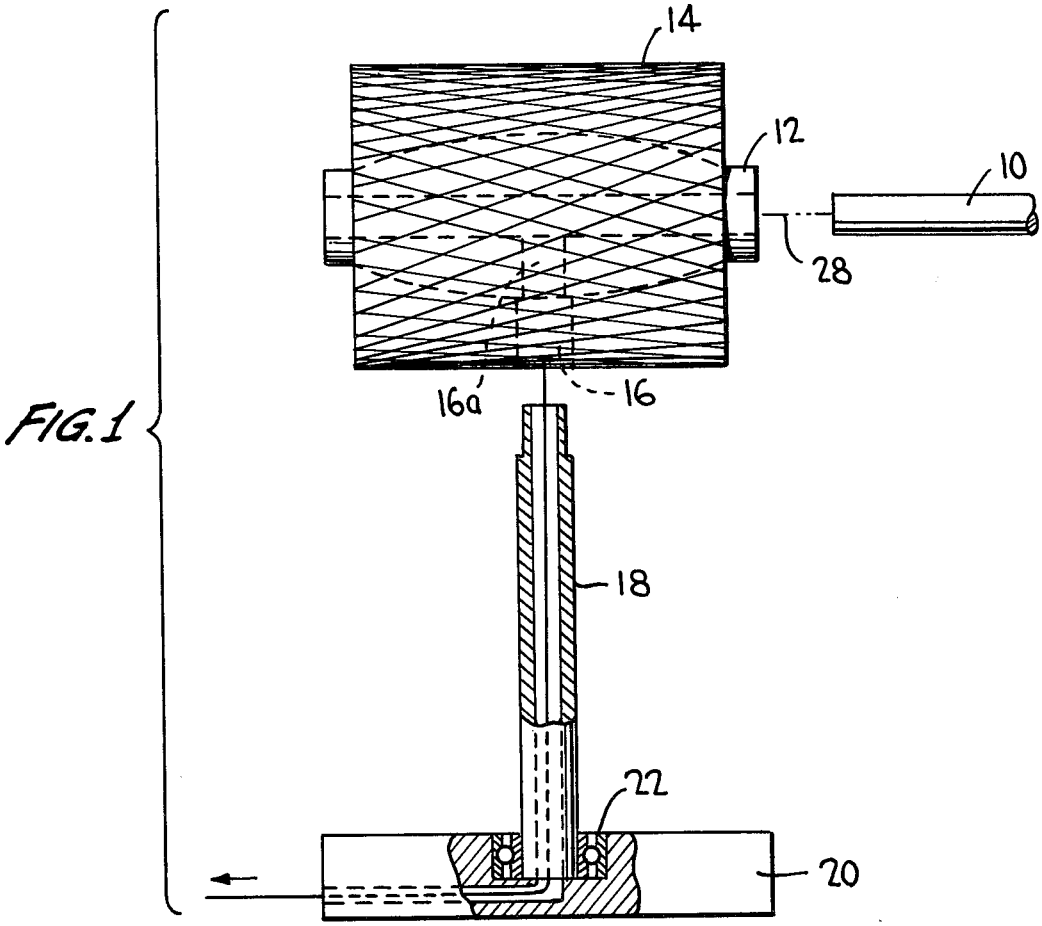
FIG. 1
FIG. 2
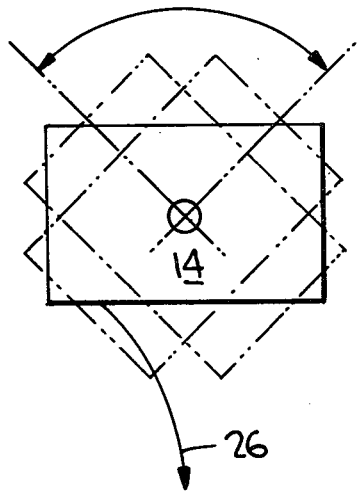
FIG. 3
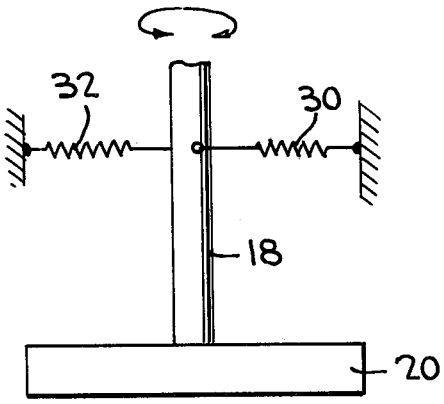

OUTSIDE PAYOFF

BACKGROUND OF THE INVENTION

1. Field of the Invention

This invention relates to method and apparatus for unwinding lengths of flexible material, and particularly to such method and apparatus for unwinding lengths of flexible material such as wire, rayon filaments, glass filament, yarn, thread, rope, ribbon, tape, slip plastic, sheeting cable and the like from tops, spools and mandrels with the unwinding proceeding from the outermost winds to the innermost winds.

2. Prior Art

A great number of different apparatus and methods have been utilized to unwind flexible material from a spindle or a mandrel; however, such apparatus and methods have involved complex machinery and are incapable of being adapted to provide a twistless payoff from a non-rotating package. Such apparatus and methods require that the winding be completely rotated and/or that a traverse be provided for the payoff of the wound material, which unnecessarily increases the cost and complexity of the unwinding equipment.

SUMMARY OF THE INVENTION

The present invention provides both apparatus and method for unwinding flexible material which has been wound in a universal type wind on a spindle or mandrel, and in particular to such windings made in accordance with a universal wind with a radial hole in which the radial hole is formed in the side of the winding. Normally, such packages of wound material are unwound by paying-off from the interior of the package.

In accordance with the present method and apparatus a twistless payoff from the outside of the wound package is obtained by removing the spindle on which the winding has been formed, inserting a support tube into the radial hole and into a socket formed in the mandrel, attaching the support tube to a base, which may include bearings to enable rotation of the support tube, and paying-off the winding from its outer diameter towards the inner windings on the mandrel. In accordance with the techniques of the present invention, the wind can be rewound in a universal wind with a radial hole configuration regardless of the amount of material unwound. Additionally, the method and apparatus of the present invention provide access to the inner end of the winding to enable a number of such windings to be cascaded or magazined for continuous payout. Also with the present method and apparatus there is no restriction on the size of the outside package diameter. Moreover, the coil is self-supporting, as it is left on the winding mandrel, and paid-off from the outside. The invention eliminates the need for slip rings or commutator structure as are often required in prior art unwinding or payout apparatus.

The material is paid-off the package by pulling the outside end of the wind. The wind is then caused to turn sufficiently to enable a coil to slip off one end and to thus pay out. Continued pulling of the line causes the wind to turn to the opposite end so that the next coil can slip off, and the winding is paid-out by oscillation of the winding and mandrel about an axis defined by the support tube.

In a modified embodiment, the support tube may be spring-loaded to maintain tension on the wind and enhance the payout of the wind by controlling the oscillation to prevent premature throw-off of the wind. The spring-loading may be effected by springs attached directly to the support tube and anchored at their opposite ends. Alternatively, the base support may include a coil spring or torque motor to accomplish the same purpose.

OBJECT OF THE INVENTION

It is a primary object of the present invention to provide a twistless payoff from a wound package of flexible strip-like material.

It is a further object of the present invention to provide a twistless payoff from the outside end of a wound package without the necessity of rotating the package around its longitudinal axis.

It is yet a further object of the present invention to enable outside payoff from a winding package which provides access to the inner end of the winding to enable such packages of wound material to be cascaded for continuous unwinding.

It is yet a further object of the present invention to provide structure which may be inserted into the radial payout hole of a wound package of flexible strip-like material to enable such material to be unwound by merely pulling the outside end of the wind.

BRIEF DESCRIPTION OF THE FIGURES

FIG. 1 shows a side view of the mandrel, the wound package, and supporting tube structure in accordance with the present invention;

FIG. 2 is a top view illustrating the manner in which the wind swivels during payoff;

Figure 3B:
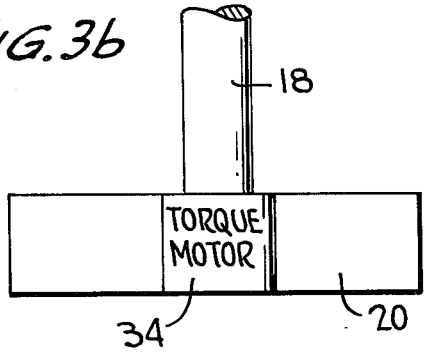
FIG. 3 is a schematic view which shows a modification in which the support tube is spring-loaded.
Figure 3C:
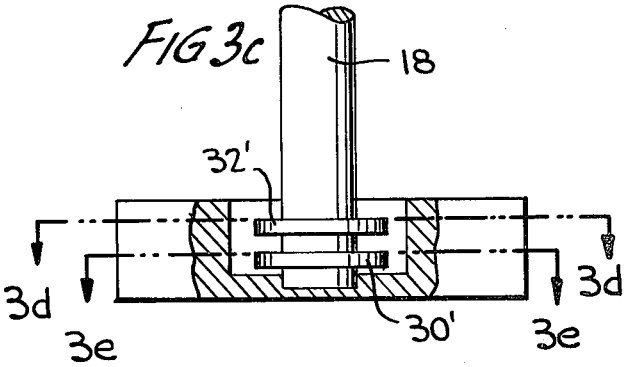
Figure 3D:
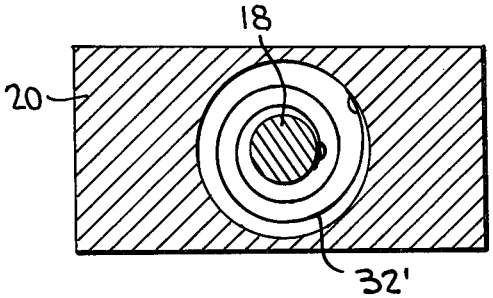
Figure 3E:
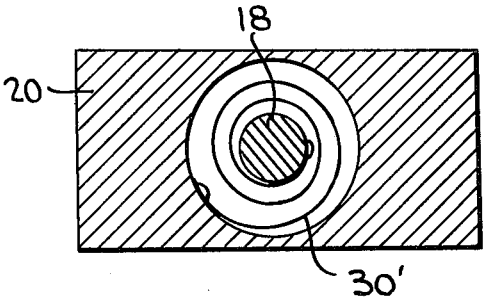
Figure 4:
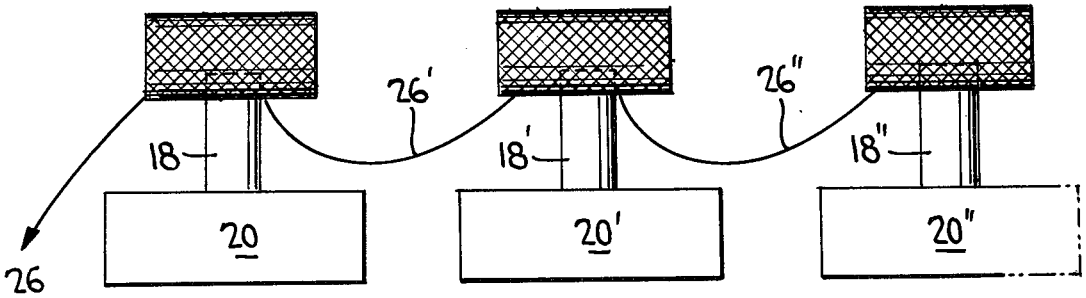

FIG. **3*b*** is a view which shows a torque motor mounted in the base for supporting the wound material;

FIGS. **3*c*–3*e* are views which show a coil spring mounted in the base for supporting the wound material; and FIG. 4** is a view which shows the cascading of a plurality of windings for continuous pay-out.

DETAILED DESCRIPTION OF THE INVENTION

With respect to FIG. 1, spindle shaft 10 is removed from mandrel 12 subsequent to the winding of the flexible material 14 on the mandrel in a manner such as to provide radial hole 16 in the wind. The techniques for winding flexible strip-like material in such a manner are well known to those skilled in the art, for example as disclosed in U.S. Pat. No. 3,178,130 and assigned to the same Assignee as the present application. Support tube 18 is then inserted into radial hole 16, and may also be inserted into a wind hole **16*a* in mandrel 12 to provide sufficient engagement of the support tube with the winding to withstand the stresses exerted during payout. Support tube 18, winding 14 and mandrel 12 are mounted on base 20 which is in turn mounted to support structure (not shown) during payout of the wind. Bearings 22 are preferably provided in base 20 to enable support tube 18 to swivel during the payout. Alternatively, a bearing may be located at the upper end of support tube 18 that is inserted into radial hole 16 and into a correspondingly aligned hole in mandrel 12**.

The flexible material is unwound from the mandrel 12 by pulling outer end 26 of wind 14 which causes wind 14 and mandrel 12 to swivel and oscillate as illustrated in FIG. 2 such that a twistless payout of the wound material is obtained without the necessity of rotating mandrel 12 about its longitudinal axis 28. The swivelling of mandrel 12, winding 14 and support tube 18 about base 20 enables the wound material to payout as the wind is allowed to turn sufficiently to enable the coil to slip off one end. Continued pulling of the line causes the wind to turn to the opposite end so that the next coil can slip off without interference with support tube 18.

In an alternative embodiment, the material can be unwound with its inner end alongside and outside the support tube. Such an arrangement is useful, for example, in cascading two or more windings as shown in FIG. 4. The inner end of one winding is connected to the outer end of another wind such that when the first winding is completely unwound the last coil thereof slips off its respective mandrel and the payout is continued from the second winding which is similarly mounted. As shown in FIG. 4, the outer coils 26, 26' and 26'' are connected to one another with their respective windings supported on support members 18, 18' and 18'' which in turn are mounted to base supports 20, 20' and 20''.

It will be apparent to those skilled in the art that the wound material may be of any size diameter on the mandrel 12, the only limitation being related to the size of support tube and base 20 necessary to support the weight and shifting of wind 14 as it is paid out. If necessary, base 20 may be mounted either vertically or in a horizontal position to a floor or wall. It is also apparent that the wind can be rewound after any amount of material has been paid out.

A further advantage is that the coil is self-supporting as it is supported by the winding mandrel as it is being unwound.

In the modified embodiment of FIG. 3, support tube 18 is tensioned by springs 30, 32. As the outer end, or payout end, of the wind is pulled, and with clockwise swivelling of support tube 18, spring 30 tensions the support rod such that it is biased to rotate counterclockwise when the winding loop has slipped off the end of the wind. A similar but reverse action is obtained when support rod 18 is rotated counterclockwise by the pull on the payout end. Springs 30, 32 thereby prevent mandrel 12, wind 14 and support tube 18 from continuing to swivel as the payout end of the wind slips off the end of the winding. The tension afforded by springs 30, 32 prevent premature throw-off of the wind, especially with high rates of payout. Alternatively, base 20 may include a coil spring or torque motor to which the support rod is mounted to provide the same tensioning forces as springs 30, 32 as respectively shown in FIGS. *3c–3e* and FIG. *3b*.

Those skilled in the art will recognize that the package of winding material may be paid out without using a mandrel, especially with certain types of flexible materials having a sufficient stiffness so as to be self-supporting when wound in a universal type wind specified herein. Also the outside end of the wind may be pulled by hand or any machine suitable for such purpose as known to those skilled in the art.

The method and apparatus disclosed herein are useful in applications in which it is necessary or desirable to connect sensing, measuring or other equipment to the inner end of the wound package. Such equipment may be easily attached to the inner end as that end may be fed out through the radial hole alongside or inside a hollow support tube to be exposed on the outside of the wound package without interfering with the unwinding of the wound package, thereby enabling the attached equipment to be operated during the unwinding operations. FIG. 1 illustrates such as application wherein an electrical connection is made for sensing, measuring equipment, etc. to the inner end of winding 14 through hollow support tube 18.

What is claimed is:

1. A method for providing outside payoff from at least one package of flexible strip-like material wound in a figure-8 pattern with a radial hole extending from the central core space of the winding to the outer coil thereof, comprising the steps of:

inserting a swivable support member having a longitudinal axis into the radial hole of the wound material;

mounting said support member to enable oscillation about the longitudinal axis thereof; and paying out the wound material from its outer end by pulling it in a direction transverse to the longitudinal axis of the wound material.

2. A method as in claim 1 further comprising the step of providing tension forces to the support member for controlling the oscillation thereof.

3. A method as in claim 1 further comprising the step of cascading two or more wound packages by successively connecting the inner end of the wound material of a first package to the outer end of the wound material of the next successive package to be unwound and similarly mounted as said package of claim 1.

4. A method as in claim 1 further comprising the steps of removing a partially unwound package from the support member and at least partially rewinding the package.

5. A method as in claim 4 wherein the steps of paying out and rewinding are repeated, alternately.

6. A method as in claim 1 further comprising the step of exposing the inner end of said wound material through the radial hole thereof outside said support member for connection to electrical equipment.

7. Apparatus for paying-off material, wound in a figure-8 pattern with a radial hole extending from the central core space of the winding to the outer coil thereof, from at least one package of the wound material from the outside of the wind, comprising:

a rotatable support member having a longitudinal axis;

mounting the winding on said support member by inserting the suppport member into the winding through said radial hole; and means for supporting said support member to enable oscillation about its longitudinal axis, whereby the material is paid-out by pulling the outer end thereof.

8. Apparatus as in claim 7 further comprising a mandrel on which the material is wound, said mandrel having means for mounting the end of said support member.

9. Apparatus as in claim 7 further comprising a plurality of packages with wound material as in claim 1 and wherein the inner end of at least one wound package is connected to the outer end of at least one other wound package whereby the wound material of said at least one other wound package is paid out subsequent to the paying-out of material from said at least one wound package.

10. Apparatus as in claim 7 further comprising means for providing tension forces to said support member during the oscillation thereof.

11. Apparatus as in claim 10 wherein said means for providing tension forces includes a pair of springs each having one end attached to said support member and the other end mounted to be stationary.

12. Apparatus as in claim 10 wherein said means for providing tension forces is a coil spring mounted in said means for supporting and engaging the end of said support member mounted therein.

13. Apparatus as in claim 10 wherein said means for providing tension forces is a torque motor mounted in said means for supporting and engaging the end of said support member mounted therein.

14. A method as in claim 1 wherein said support member is hollow and further comprising the step of exposing the inner end of said wound material through the hollow support member for connection to electrical equipment.

15. A method as in claim 2 wherein said step of providing tension forces includes the step of applying tension forces to said support member in opposition to the pulling force on said outer end.

16. Apparatus as in claim 7 wherein the inner end of said wound material is exposed through the radial hole thereof outside said support member for connection to electrical equipment.

17. Apparatus as in claim 7 wherein said support member is hollow and the inner end of said wound material is exposed through the radial hole thereof and the hollow support member for connection to electrical equipment.

* * * * *